US010480859B2

(12) United States Patent
Hirato et al.

(10) Patent No.: US 10,480,859 B2
(45) Date of Patent: Nov. 19, 2019

(54) CARRIER-TYPE HEAT-TREATMENT APPARATUS

(71) Applicant: Sumitomo Electric Sintered Alloy, Ltd., Takahashi-shi (JP)

(72) Inventors: Hidehisa Hirato, Itami (JP); Naoto Igarashi, Itami (JP)

(73) Assignee: SUMITOMO ELECTRIC SINTERED ALLOY, LTD., Takahashi-shi (JP)

( * ) Notice: Subject to any disclaimer, the term of this patent is extended or adjusted under 35 U.S.C. 154(b) by 173 days.

(21) Appl. No.: 15/560,314

(22) PCT Filed: Mar. 14, 2016

(86) PCT No.: PCT/JP2016/057896
§ 371 (c)(1),
(2) Date: Sep. 21, 2017

(87) PCT Pub. No.: WO2016/158335
PCT Pub. Date: Oct. 6, 2016

(65) Prior Publication Data

US 2018/0051930 A1 Feb. 22, 2018

(30) Foreign Application Priority Data

Mar. 27, 2015 (JP) ..... 2015-067696

(51) Int. Cl.
*F27B 9/04* (2006.01)
*B22F 3/24* (2006.01)
(Continued)

(52) U.S. Cl.
CPC ..... *F27B 9/045* (2013.01); *B22F 3/003* (2013.01); *B22F 3/24* (2013.01); *F27B 9/047* (2013.01);
(Continued)

(58) Field of Classification Search
CPC ..... F27B 9/045; F27B 9/24
See application file for complete search history.

(56) References Cited

U.S. PATENT DOCUMENTS

2007/0122936 A1* 5/2007 Park ..... H01L 21/67109 438/77
2010/0226629 A1* 9/2010 Basol ..... C23C 14/5866 392/407
2015/0354892 A1* 12/2015 Fujita ..... F26B 13/10 34/267

FOREIGN PATENT DOCUMENTS

JP 62-055092 U1 4/1987
JP 02-044185 A 2/1990
(Continued)

*Primary Examiner* — Scott R Kastler
(74) *Attorney, Agent, or Firm* — Baker Botts L.L.P.; Michael A. Sartori

(57) ABSTRACT

A carrier-type heat-treatment apparatus including a furnace main body that includes heaters and a mesh belt that transports an object to be heat-treated into the furnace main body includes a gas pipe arranged inside the furnace main body, the gas pipe being configured to inject a gas into the furnace main body, in which a low-temperature zone and a high-temperature zone are provided inside the furnace main body with the gas, the low-temperature zone being provided on an entrance side of the furnace main body, the high-temperature zone being provided on an exit side of the furnace main body and having a temperature higher than the low-temperature zone.

6 Claims, 7 Drawing Sheets

(51) Int. Cl.

| | |
|---|---|
| ***F27B 9/24*** | (2006.01) |
| ***F27B 9/36*** | (2006.01) |
| ***H01F 3/08*** | (2006.01) |
| ***B22F 3/00*** | (2006.01) |
| *H01F 41/02* | (2006.01) |

(52) U.S. Cl.
CPC ..... *F27B 9/24* (2013.01); *F27B 9/36* (2013.01); *H01F 3/08* (2013.01); *B22F 2998/10* (2013.01); *B22F 2999/00* (2013.01); *H01F 41/0206* (2013.01)

(56) References Cited

FOREIGN PATENT DOCUMENTS

| | | | |
|---|---|---|---|
| JP | 2001-147083 | A | 5/2001 |
| JP | 2005-347001 | A | 12/2005 |
| JP | 2008-292117 | A | 12/2008 |
| JP | 2011-064425 | A | 3/2011 |
| JP | 2013-214664 | A | 10/2013 |

* cited by examiner

CARRIER-TYPE HEAT-TREATMENT APPARATUS

TECHNICAL FIELD

The present invention relates to a carrier-type heat-treatment apparatus.

BACKGROUND ART

Carrier-type heat-treatment apparatuses such as a mesh belt furnace described in Patent Literature 1 are known as apparatuses for heat-treating objects to be heat-treated. The mesh belt furnace includes a furnace main body including heaters, and a mesh belt that transports an object to be heat-treated thereinto. The mesh belt includes a mesh portion having a grid-net-like shape, the mesh portion being arranged on a surface of a conveyor portion formed of, for example, a steel band. This structure of the mesh belt enables an atmosphere in the furnace main body to be brought into contact with all peripheral surfaces of the object to be heat-treated. Furthermore, in Patent Literature 1, a mesh stage is arranged on the mesh belt to convect the atmosphere between the mesh belt and the mesh stage, thereby uniformly heat-treating the object to be heat-treated. Such carrier-type heat-treatment apparatuses are widely used because a large number of objects to be heat-treated can be heat-treated in one operation.

CITATION LIST

Patent Literature

PTL 1: JP2013-214664A

SUMMARY OF INVENTION

Technical Problem

Among objects to be heat-treated, some objects to be heat-treated require two-stage heat treatment: heating is performed at a predetermined temperature for a predetermined time, and then heating is performed at a temperature higher than the predetermined temperature for a predetermined time. When this two-stage heat treatment can be performed with a carrier-type heat-treatment apparatus, a large number of objects to be heat-treated can be efficiently heat-treated. However, in the carrier-type heat-treatment apparatus, it is difficult to perform the two-stage heat treatment. The reason for this is that because a furnace main body has a continuous inside portion, even if a low-temperature zone and a high-temperature zone having a temperature higher than the low-temperature zone are provided, heat in the high-temperature zone is transferred to the low-temperature zone, and it is thus difficult to maintain the low-temperature zone in a predetermined temperature range.

The present invention has been accomplished in light of the foregoing circumstances. It is an object of the present invention to provide a carrier-type heat-treatment apparatus that can perform two-stage heat treatment.

Solution to Problem

According to an aspect of the present invention, a carrier-type heat-treatment apparatus including a furnace main body that includes heaters and a mesh belt that transports an object to be heat-treated into the furnace main body includes a gas pipe arranged inside the furnace main body, the gas pipe being configured to inject a gas into the furnace main body, in which a low-temperature zone and a high-temperature zone are provided inside the furnace main body with the gas, the low-temperature zone being provided on an entrance side of the furnace main body, the high-temperature zone being provided on an exit side of the furnace main body and having a temperature higher than the low-temperature zone.

Advantageous Effects of Invention

According to the carrier-type heat-treatment apparatus, two-stage heat treatment can be performed.

DESCRIPTION OF EMBODIMENTS

Description of Embodiments of Invention

Figure 1:
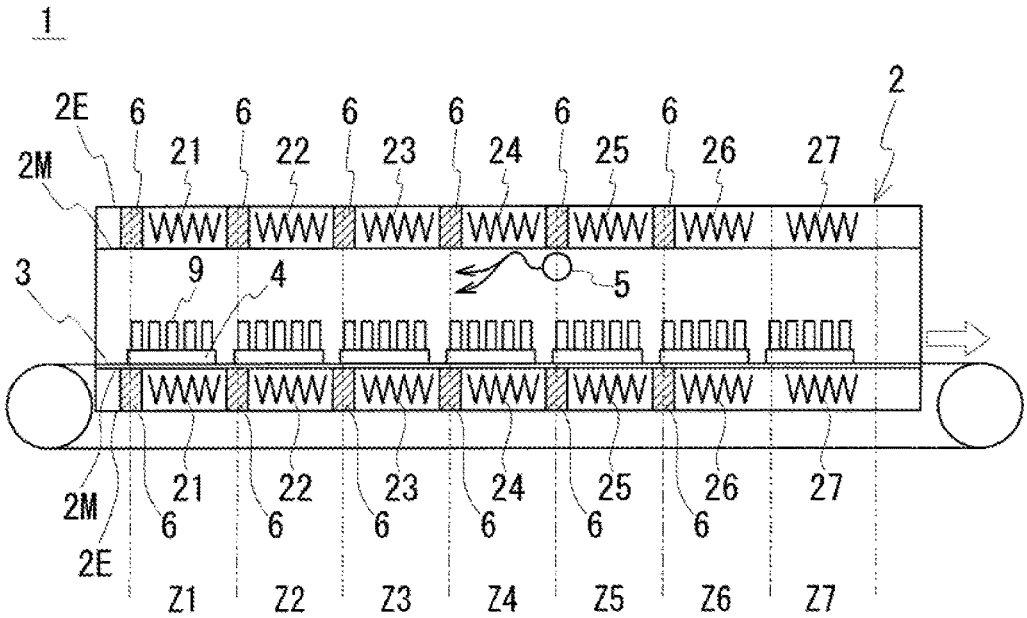
FIG. 1 is a schematic diagram of a carrier-type heat-treatment apparatus illustrated in an embodiment.

Embodiments of the present invention are first listed and explained.

<1> According to an embodiment, a carrier-type heat-treatment apparatus including a furnace main body that includes heaters and a mesh belt that transports an object to be heat-treated into the furnace main body includes a gas pipe arranged inside the furnace main body, the gas pipe being configured to inject a gas into the furnace main body, in which a low-temperature zone and a high-temperature zone are provided inside the furnace main body with the gas, the low-temperature zone being provided on an entrance side of the furnace main body, the high-temperature zone being provided on an exit side of the furnace main body and having a temperature higher than the low-temperature zone.

The injection of the gas into the furnace main body cools a hot atmosphere that flows from the high-temperature zone to the low-temperature zone to form the difference in temperature between the high-temperature zone and the low-temperature zone, so that two-stage heating can be performed even in the case of the carrier-type heat-treatment apparatus.

<2> In the carrier-type heat-treatment apparatus according to an embodiment, the gas pipe may be arranged above the mesh belt and in a direction intersecting a direction of motion of the mesh belt, and the gas pipe may include a nozzle arranged on a peripheral wall thereof, the nozzle being configured to inject the gas.

In the foregoing structure, the gas can be uniformly injected over the entire length of the mesh belt in the width direction. Thus, with regard to the temperature of an atmosphere in the furnace, the high-temperature zone filled with a high-temperature atmosphere and the low-temperature zone filled with a low-temperature atmosphere can be more reliably provided.

<3> In the carrier-type heat-treatment apparatus according to an embodiment, an injection direction of the gas may be a direction toward an upper portion of the low-temperature zone rather than a vertically downward direction.

Since the injection direction is a direction toward the upper portion of the low-temperature zone, the temperature of the entire low-temperature zone adjacent to the high-temperature zone is easily maintained by the use of the diffused gas to which an object to be heat-treated is directly exposed.

<4> In the carrier-type heat-treatment apparatus according to an embodiment, the gas may have a temperature equal to or lower than a set temperature of the low-temperature zone.

Since the gas has a temperature equal to or lower than the set temperature of the low-temperature zone, it is possible to avoid an increase in the temperature of the low-temperature zone and easily maintain the low-temperature zone to a temperature in a predetermined temperature range.

<5> In the carrier-type heat-treatment apparatus according to an embodiment, the gas may be an inert gas.

The use of the inert gas as the gas can also improve the quality of a surface of an object to be heat-treated.

<6> In the carrier-type heat-treatment apparatus according to an embodiment, the heaters may be aligned in a transportation direction of the object to be heat-treated, and a heat insulator may be arranged in a gap that is selected from gaps between the heaters aligned in the transportation direction and that is located in the vicinity of the gas pipe.

The arrangement of the heat insulator in the gap between adjacent heaters in the vicinity of the gas pipe can inhibit the transfer of heat from one heater located on the high-temperature side of the gap to the other heater located on the low-temperature side. It is thus possible to avoid an increase in the temperature of the low-temperature zone and easily maintain the low-temperature zone to a predetermined temperature range.

<7> The carrier-type heat-treatment apparatus according to an embodiment may further include a flow gas introduction mechanism configured to introduce a flow gas from the exit side toward the entrance side of the furnace main body, in which the flow gas may be air.

The use of air as the flow gas can eliminate the preparation of the flow gas or a storage facility that stores a flow gas and thus can reduce the unit price of heat treatment correspondingly.

Details of Embodiments of Invention

Details of embodiments of the present invention will be described below with reference to the drawings. The present invention is not limited to these embodiments and is indicated by the appended claims. It is intended to include any modifications within the scope and meaning equivalent to the scope of the claims.

First Embodiment

<<Carrier-Type Heat-Treatment Apparatus>>

Figure 2:
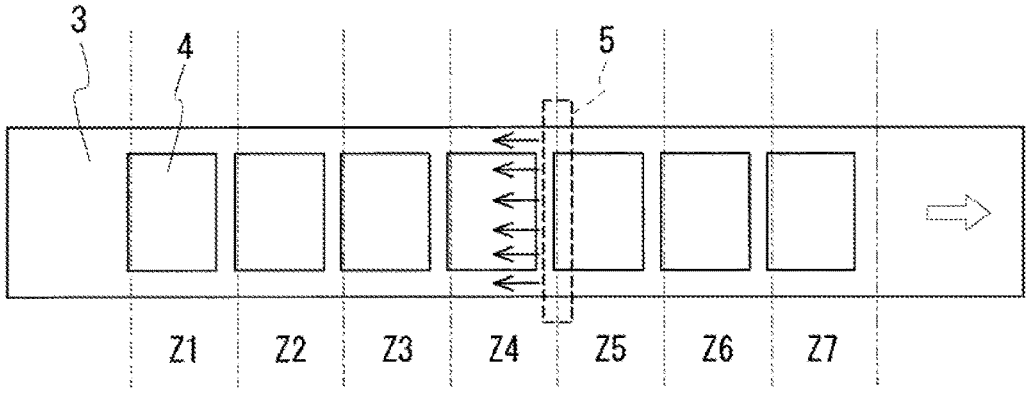
FIG. 2 is a schematic top view of a mesh belt of a carrier-type heat-treatment apparatus.

In a first embodiment, a carrier-type heat-treatment apparatus 1 that can perform two-stage heat treatment is described with reference to FIGS. 1 and 2. FIG. 1 is a schematic diagram of the carrier-type heat-treatment apparatus 1. FIG. 2 is a schematic top view of a mesh belt 3 included in the carrier-type heat-treatment apparatus 1.

The carrier-type heat-treatment apparatus 1 illustrated in FIG. 1 includes a furnace main body 2 including heaters 21 to 27, and the mesh belt 3 that introduces objects to be heat-treated 9 into the furnace main body 2. Mesh stages 4 including depressions corresponding to the size of the object to be heat-treated 9 are provided on the mesh belt 3. Thus, the objects to be heat-treated 9 can be heat-treated in one operation in a state of being arranged. The mesh stages 4 have a raised bottom, thereby forming a predetermined gap between the mesh belt 3 and each mesh stage 4. This enables the production of the convection of an atmosphere in the gaps during the heat treatment of the objects to be heat-treated 9.

[Furnace Main Body]

The furnace main body 2 includes an exterior 2E and a muffle (partition) 2M arranged therein. One end of the inside of the muffle 2M communicates with the other end. The upper half of the mesh belt 3 is arranged in the muffle (partition) 2M of the furnace main body 2. The heaters 21 to 27 aligned in the transportation direction of the objects to be heat-treated 9 are arranged between the exterior 2E and the muffle 2M and are configured to heat the outer periphery of the muffle 2M.

The heaters 21 to 27 arranged in the furnace main body 2 can individually control the temperature. Thus, the heating temperature can be gradually increased from the entrance of the muffle 2M (upstream in the transportation direction) on the left side of the paper toward the exit of the muffle 2M (downstream in the transportation direction) on the right side of the paper. Furthermore, in this embodiment, the space between the outer periphery of the muffle 2M and the inner periphery of the exterior 2E is partitioned with heat insulators 6, so that heat of one of two adjacent heaters is less likely to be transferred to the other heater. Thus, the temperatures of zones Z1 to Z7, described below, in the muffle 2M can be easily and individually controlled. In this embodiment, the heat insulators 6 are located on the entrance side of the furnace main body 2 (on the left side of the paper) with respect to the heater 21, between the heaters 21 and 22, between the heaters 22 and 23, between the heaters 23 and 24, between the heaters 24 and 25, and between the heaters 25 and 26.

[Mesh Belt and Mesh Stage]

As the mesh belt 3 and the mesh stages 4, a known components can be used. For example, those described in Patent Literature 1 (Japanese Unexamined Patent Application Publication No. 2013-214664) can be used.

[Gas Pipe]

The inside of the furnace main body 2 is virtually divided into the seven zones (Z1 to Z7) with the heaters 21 to 27 individually controlled. However, because the furnace main body 2 has a continuous inside portion, it is difficult to maintain the temperatures of the zones Z1 to Z7 to desired temperatures. Thus, in this embodiment, a gas pipe 5 is arranged over the mesh belt 3 (see also FIG. 2) and between the heaters 24 and 25. A gas is injected through the gas pipe 5. The gas pipe 5 has nozzles arranged on its peripheral wall and thus can uniformly inject the gas over the entire length of the mesh belt 3 in the width direction. The gas injection can produce a clear difference in temperature between the zones Z4 and Z5, thereby providing a low-temperature zone and a high-temperature zone in the furnace main body 2. This does not change the temperature in a curved manner but can facilitate a change in temperature in a linear manner between the low-temperature zone and the high-temperature zone. In the embodiment illustrated, the low-temperature zone is provided in the zones Z2 to Z4 on the left side of the paper with respect to the gas pipe 5, and the high-temperature zone is provided in the zones Z6 and Z7 on the right side of the paper.

Amount of Gas Injected

The amount of the gas injected through the gas pipe 5 needs to be an amount capable of promoting the decomposition of a compacting assistant (described below) bleeding from the object to be heat-treated and capable of providing the difference in temperature between the low-temperature zone and the high-temperature zone. The use of an insufficient amount of the gas injected through the gas pipe 5 can fail to produce a clear difference in temperature between the low-temperature zone and the high-temperature zone. A preferred amount of the gas injected varies, depending on the temperature of the gas and the difference in temperature between the low-temperature zone and the high-temperature zone, and is thus difficult to clearly specify. For example, in the case of the gas having normal temperature, the amount of the gas injected is about 200 L (liters)/min or more and about 600 L/min or less.

Injection Direction of Gas

The injection direction of the gas through the gas pipe 5 is preferably a direction toward an upper portion of the low-temperature zone (entrance side in the transportation direction) rather than a vertically downward direction. In this case, the gas is diffused in the entire low-temperature zone adjacent to the high-temperature zone; thus, the temperature of the low-temperature zone is easily maintained.

Temperature of Gas

The temperature of the gas is preferably equal to or lower than a set temperature of the low-temperature zone. In this case, it is possible to avoid an increase in the temperature of the low-temperature zone and maintain the low-temperature zone at a temperature in a set temperature range. The temperature of the gas may also be appropriately changed. In this case, the low-temperature zone is easily maintained at a constant temperature by arranging a temperature sensor in the furnace main body 2, changing the temperature of the gas on the basis of detection results of the temperature sensor, and injecting the gas into the furnace main body 2.

Type of Gas

The type of the gas is not particularly limited. For example, air can be used as the gas, and an inert gas (for example, $N_2$ gas or Ar gas) can also be used. In the case where air is used as the gas, the gas need not be prepared separately, thus reducing the production costs of the objects to be heat-treated 9. In the case where the inert gas is used as the gas, although an inert gas storage facility is required, residues, described below, are less likely to be formed on surfaces of the objects to be heat-treated 9 during the heat treatment.

[Others]

The carrier-type heat-treatment apparatus 1 of this embodiment includes a structure that introduces a flow gas from the exit side toward the entrance side of the furnace main body 2. As the flow gas, air or an inert gas (for example, $N_2$ gas or Ar gas) can be used. In the case where air is used as the flow gas, the flow gas need not be prepared separately, thus reducing the production costs of the objects to be heat-treated 9. In the case where the inert gas is used as the flow gas, although an inert gas storage facility is required, residues are less likely to be formed on surfaces of the objects to be heat-treated 9 during the heat treatment.

[Operation of Carrier-Type Heat-Treatment Apparatus]

Figure 3:
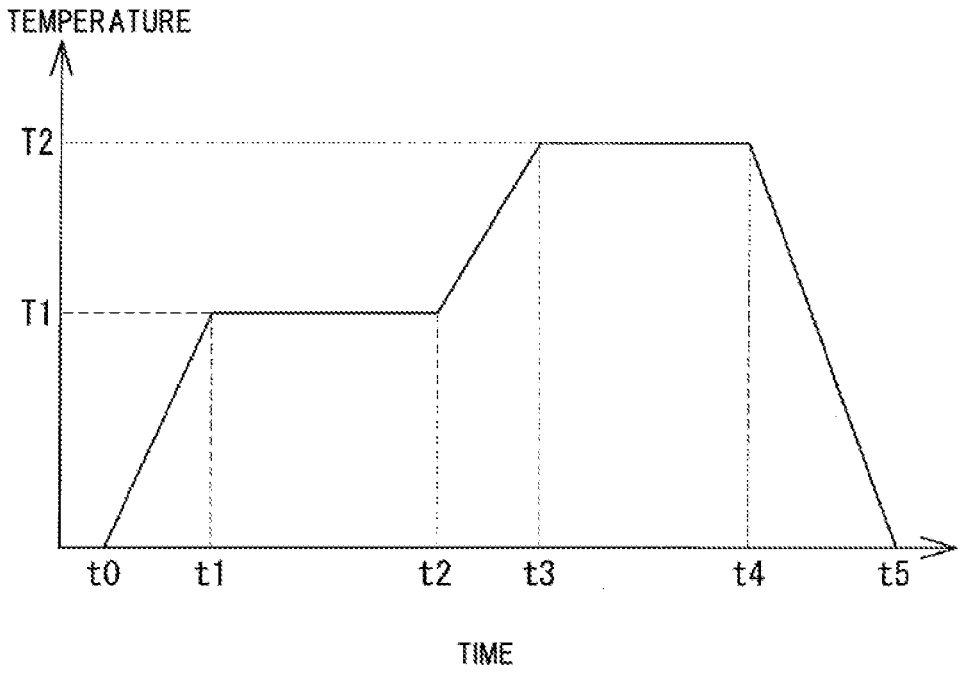
FIG. 3 illustrates a temperature profile for an object to be heat-treated with a carrier-type heat-treatment apparatus illustrated in an embodiment.

In the carrier-type heat-treatment apparatus 1 having the foregoing structure, when the temperature is increased from the heater 21 toward the heater 27, the objects to be heat-treated 9 can be heat-treated with a temperature profile illustrated in FIG. 3. FIG. 3 illustrates the temperature profile for the objects to be heat-treated 9. The horizontal axis represents time, and the vertical axis represents temperature. As illustrated in FIG. 3, in the carrier-type heat-treatment apparatus 1 according to the embodiment, between the start (t0) and the end (t5) of heating, an object to be heat-treated is held for a predetermined time (t1→t2) at T1° C., and then a second-stage heat treatment can be performed in which the object to be heat-treated is held for a predetermined time (t3→t4) at T2° C. higher than T1° C. In FIG. 3, t1→t2 corresponds to heating in the low-temperature zone of the carrier-type heat-treatment apparatus 1, and t3→t4 corresponds to heating in the high-temperature zone.

<<Example of Object to be Heat-Treated>>

Examples of the object to be heat-treated with the carrier-type heat-treatment apparatus 1 include dust cores used for magnetic components, such as motors, transformers, reactors, and choke coils, for use in in-vehicle components mounted on vehicles, such as hybrid automobiles and electric vehicles, and power supply circuit components of various electric devices.

A dust core is produced by compacting a soft magnetic powder together with a compacting assistant, the soft magnetic powder being collections of coated particles that are soft magnetic metal particles having outer peripheries coated with insulating coatings, the soft magnetic metal particles being composed of, for example, iron or an iron-based alloy. Examples of the compacting assistant include (1) an internal lubricant that is mixed with the soft magnetic powder to inhibit the damage of the insulating coating; (2) a binder that is mixed with the soft magnetic powder; and (3) an external lubricant that is applied or sprayed onto the inner periphery of a die used for compacting. In the dust core, distortion is introduced into the soft magnetic metal particles of a compact during the compacting. When a magnetic component including the dust core is used at a high frequency such as several kilohertz, the distortion introduced into the soft magnetic metal particles causes an increase in hysteresis loss. The compact after the compacting is subjected to heat treatment to remove the distortion. A product subjected to final heat treatment is referred to as a "dust core".

When the compact is subjected to heat treatment, a residue formed by carbonization of the compacting assistant is disadvantageously liable to adhere to a surface of the dust core. The compacting assistant bleeds from the surface of the compact in the course of the heat treatment of the compact, is oxidized by the heat treatment, and then is carbonized by an increase in temperature. In particular, in the cases of, for example, boxy dust cores and dust cores having a flange portion, the compacting assistant is easily accumulated in edge portions that are boundaries of planes, thus leading to significant adhesion of the residue to the boundaries. Although the residue does not decrease the magnetic performance of the dust core itself, the residue can lead to a decrease in the performance of a magnetic component including the dust core. The residue formed by the carbonization of the compacting assistant is conductive. Thus, for example, in the case where a choke coil is produced with a dust core to which a residue adheres, the residue can be released from the dust core and can adhere to the coil to degrade the insulation performance of the coil.

In light of the foregoing problems, the inventors have conducted studies on a mechanism to allow a residue to be left on a surface of a dust core during heat treatment of a compact and have found that a two-stage heat treatment in which a compact is heated for a predetermined time at a temperature in a decomposition temperature range where a compacting assistant is decomposed and evaporated, and then the compact is heated at a distortion removal temperature higher than the decomposition temperature, is effective in producing a dust core free from a residue on a surface thereof. It is thus considered that when the compact is heat-treated with the carrier-type heat-treatment apparatus 1 described with reference to FIGS. 1 and 2, the compact can be heat-treated in such a manner that no residue is left on the surface.

An example of the structure of the compact to be heat-treated will be described below.

[Soft Magnetic Metal Particles]

A material of the soft magnetic metal particles preferably contains 50% or more by mass iron. Examples thereof include pure iron (Fe) and an iron alloy selected from the group consisting of Fe—Si-based alloys, Fe—Al-based alloys, Fe—N-based alloys, Fe—Ni-based alloys, Fe—C-based alloys, Fe—B-based alloys, Fe—Co-based alloys, Fe—P-based alloys, Fe—Ni—Co-based alloys, and Fe—Al—Si-based alloys. In particular, pure iron containing 99% or more by mass Fe is preferred in view of magnetic permeability and flux density.

The soft magnetic metal particles preferably have an average particle size d of 10 μm or more and 300 μm or less. An average particle size d of 10 μm or more results in good flowability and inhibition of an increase in the hysteresis loss of a dust core. An average particle size d of 300 μm or less results in an effective reduction in the eddy current loss of the dust core. In particular, at an average particle size d of 50 μm or more, the effect of reducing the hysteresis loss is easily provided, and the powder is easily handled. The average particle size d refers to 50% particle size (mass), which means, in the histogram of the particle size, the size of particles where the sum of the masses of the smaller particles accounts for 50% of the total mass.

[Insulating Coating]

The insulating coating can be composed of a metal oxide, a metal nitride, a metal carbide, or the like, for example, an oxide, a nitride, or a carbide of one or more metal elements selected from Fe, Al, Ca, Mn, Zn, Mg, V, Cr, Y, Ba, Sr, rare-earth elements (excluding Y), and so forth. The insulating coating may also be composed of, for example, one or more compounds selected from phosphorus compounds, silicon compounds (such as silicone resins), zirconium compounds, and aluminum compounds. The insulating coating may also be composed of a metal salt compound, such as a metal phosphate compound (typically, iron phosphate, manganese phosphate, zinc phosphate, calcium phosphate, or the like), a metal borate compound, a metal silicate compound, a metal titanate compound, or the like.

The insulating coating preferably has a thickness of 10 nm or more and 1 μm or less. A thickness of 10 nm or more can result in a good insulation between the soft magnetic metal particles. At a thickness of 1 μm or less, the presence of the insulating coating can inhibit a decrease in the soft magnetic powder content of the dust core.

[Compacting Assistant]

An example of the compacting assistant is an internal lubricant that is mixed with the soft magnetic powder. The incorporation of the internal lubricant into the soft magnetic powder inhibits the coated particles from being strongly rubbed against each other, so that the insulating coating of each of the coated particles is less likely to be damaged. The internal lubricant may be a liquid lubricant or a solid lubricant formed of a lubricant powder. In particular, the internal lubricant is preferably a solid lubricant in view of easy mixing with the soft magnetic powder. As the solid lubricant, a material that is easily and uniformly mixed with the soft magnetic powder, that is sufficiently deformable between the coated particles during the formation of a compact, and that is easily removed by heating for the heat treatment of the compact can be preferably used. For example, a metal soap, such as lithium stearate or zinc stearate, can be used as the solid lubricant. In addition, a fatty acid amide, such as lauramide, stearamide, or palmitamide, or a higher fatty acid, such as ethylenebis(stearamide), can be used.

With regard to a preferred amount of the internal lubricant mixed, the amount of the internal lubricant mixed with the coated soft magnetic powder is preferably 0.2% by mass to 0.8% by mass with respect to 100 of the coated soft magnetic powder. The solid lubricant constituting the internal lubricant is a solid lubricant having a maximum size of 50 μm or less. In the case of the solid lubricant of this size, the internal lubricant particles easily interpose between the coated soft magnetic particles to effectively reduce the friction between the coated soft magnetic particles, thus effectively preventing the damage of the insulating coating of the coated soft magnetic powder. In the case of mixing the internal lubricant with the coated soft magnetic powder, a double cone mixer or a V mixer may be used.

Another example of the compacting assistant is an external lubricant that is applied or sprayed onto an inner periphery of a die at the time of compacting. The use of the external lubricant reduces the friction between the inner periphery of the die and the outer periphery of the compact to inhibit the damage of the surface of the compact. The external lubricant may be in the form of a solid or liquid. The same material as the internal lubricant as described above can be used therefor.

[Compacting]

A pressure at which a mixture of the soft magnetic powder and the compacting assistant is subjected to compacting is preferably 390 MPa or more and 1,500 MPa or less. A pressure of 390 MPa or more results in sufficient compaction of the soft magnetic powder to provide a high relative density of the compact. A pressure of 1,500 MPa or less results in the inhibition of the damage of the insulating coating due to contact between the coated particles included in the soft magnetic powder. The pressure is more preferably 700 MPa or more and 1,300 MPa or less.

<<Method for Heat-Treating Compact>>

In the case where heat treatment to remove the distortion introduced into the compact during the compacting is performed with the carrier-type heat-treatment apparatus illustrated in FIGS. 1 and 2, two-stage heat treatment is performed as described below. The description will be made with reference to the temperature profile in FIG. 3.

As illustrated in FIG. 3, when the compact is heat-treated, between the start (t0) and the end (t5) of heating, the compact is held for a predetermined time (t1→t2) at a temperature (T1) in the decomposition temperature range of the compacting assistant in the compact, and then a second-stage heat treatment is performed in which the compact is held for a predetermined time (t3→t4) at a distortion removal temperature (T2) to remove the distortion introduced into the compact.

A heating rate (° C./min) when the compact is heated to the temperature (T1) in the decomposition temperature range can be appropriately selected. For example, the heating rate can be 2° C./min or more and 25° C./min or less. The heating rate is more preferably 3° C./min or more and 10° C./min or less. The time (t1) required to reach the decomposition temperature range varies, depending on the heating rate.

The decomposition temperature range of the compacting assistant varies, depending on the type of compacting assistant. Thus, a preliminary test with a compacting assistant used for a compact is performed to study [1] the decomposition temperature range of the compacting assistant and [2] the degrees of the decomposition and evaporation of the compacting assistant depending on the holding time of the compact in the decomposition temperature range. Based on the results, a first-stage heat treatment of the compact is performed. As described in test examples below, in the case of stearamide, the decomposition temperature range is about 171° C. to about 265° C., and the holding time in the decomposition temperature range is 30 minutes or more. The actual heat-treatment temperature is preferably a temperature slightly lower than a temperature at which the maximum amount of the compacting assistant decomposed is obtained (temperature at which the peak of an exothermic reaction is observed).

The heating rate (° C./min) when the compact is heated to the distortion removal temperature after the end (t2) of the first-stage heat treatment can be appropriately selected. For example, the heating rate is 2° C./min or more and 25° C./min or less. The heating rate is more preferably 5° C./min or more and 15° C./min or less. The time (t3) required to reach the distortion removal temperature varies, depending on the heating rate.

The distortion removal temperature (T2) and its holding time to remove the distortion introduced into the soft magnetic metal particles of the compact vary, depending on the type of soft magnetic metal particle. Thus, the distortion removal temperature and the holding time corresponding to the type of soft magnetic metal particle are studied in advance, and the second-stage heat treatment of the compact is performed on the basis of the distortion removal temperature and the holding time. For example, in the case of pure iron, the compact may be held at 300° C. or higher and 700° C. or lower for 5 minutes or more and 60 minutes or less.

After the end (t4) of the second-stage heat treatment, the cooling rate of the compact can be appropriately selected. For example, the cooling rate is 2° C./min or more and 50° C./min or less. The cooling rate is more preferably 10° C./min or more and 30° C./min or less. The cooling of the compact can be performed by air cooling.

When the two-stage heat treatment described above is performed, the compacting assistant on a surface of the compact can be removed by the first-stage heat treatment, and the distortion introduced into the soft magnetic metal particles of the compact can be removed by the second-stage heat treatment.

To perform the two-stage heat treatment with the carrier-type heat-treatment apparatus, in this embodiment, a gas is injected into the furnace main body of the carrier-type heat-treatment apparatus to form the low-temperature zone heated and maintained at a temperature (T1° C.) in the decomposition temperature range and the high-temperature zone heated and maintained at the distortion removal temperature (T2° C.) in the furnace main body. After the low-temperature zone and the high-temperature zone are formed in the furnace main body, the compact is transported to the furnace main body and then heat-treated.

<<Dust Core after Heat Treatment>>

The heat treatment of the compact with the carrier-type heat-treatment apparatus 1 that has been described above can provide a dust core having a uniform oxide coating formed on all peripheral surfaces of the dust core by the heat treatment, in which substantially no residue formed by carbonization of a compacting assistant adheres to a surface of the dust core. The expression "substantially no residue adheres" used here indicates that "no residue is visually observed".

The inner portion of the dust core after the heat treatment contains a trace amount of the compacting assistant used for compacting. The presence of the compacting assistant can be identified by, for example, energy-dispersive X-ray spectroscopy (EDX).

Whether the oxide coating is formed on all the peripheral surfaces or not can be visually identified because the surface color of the dust core after the heat treatment is clearly different from the surface color of the dust core before the heat treatment.

The fact that no residue formed by the carbonization of the compacting assistant adheres to a surface of the dust core can be visually identified. This is because the residue has a clearly different color from the oxide coating. As described in test examples described below, the fact that no residue adheres to a surface of the dust core can be identified by measuring the amount of carbon (C) on the surface of the dust core. The fact that no residue adheres to a surface of the dust core indicates that the amount of surface C of the dust core is 50 at % (atomic percent) or less. The amount of surface C is an index to confirm that no residue adheres to the surface of the dust core, and is the percentage of C with respect to the total amount of atoms detected in the analysis of constituent elements on the surface.

The dust core having no residue on a surface thereof can be suitably used for the production of a magnetic component such as a choke coil. This is because when the magnetic component is assembled, a residue does not adhere to a coil or the like to impair the insulating properties of the coil.

The dust core that has been subjected to the two-stage heat treatment with the carrier-type heat-treatment apparatus 1 has improved DC magnetization characteristics (maximum relative magnetic permeability $\mu_m$) and transverse rupture strength, compared with conventional dust cores that have been a single-stage heat treatment. Specifically, the dust core that has been subjected to the two-stage heat treatment has a maximum relative magnetic permeability $\mu_m$ of 580 or more, which is about 1.1 to about 1.2 times those of conventional dust cores. The transverse rupture strength of the dust core that has been subjected to the two-stage heat treatment is 70 MPa or more, which is about 1.5 to about 2 or more times those of conventional dust cores. The improvement of the characteristics is seemingly provided by removing almost all the compacting assistant from the inside of the dust core through the first-stage heat treatment. If the compacting assistant is left in the dust core, the second-stage heat treatment seems to form a carbonized material of the compacting assistant in the dust core, and the carbonized material seemingly degrades the magnetic and strength characteristics of the dust core.

Thus, a sufficient removal of the compacting assistant from the inside of the dust core through the first-stage heat treatment seemingly improves the characteristics of the dust core provided through the second-stage heat treatment.

Test Examples

In test examples, examples in which compacts are actually heat-treated with the carrier-type heat-treatment apparatus 1 illustrated in FIGS. 1 and 2 are described. Specifically, an optimal decomposition temperature and its holding time corresponding to the type of internal lubricant (compacting assistant) were determined. A dust core was actually produced by performing holding at the decomposition temperature for a predetermined time and then performing distortion removal. The presence or absence of a residue (carbonized material of the internal lubricant) on a surface of the dust core was checked.

<<Test 1>>

Figure 4:
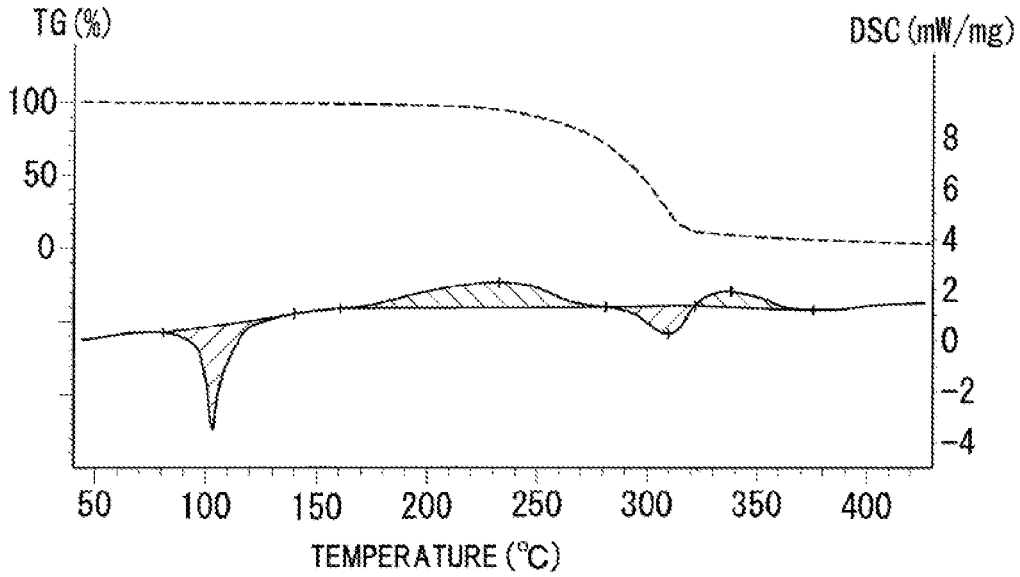
FIG. 4 is a graph depicting the results of thermogravimetry-differential scanning calorimetry of an internal lubricant described in test 1.

To determine an optimal temperature at which the internal lubricant used for the formation of a compact is decomposed, the change of the internal lubricant was first studied when the internal lubricant was heated. The measured internal lubricant was stearamide, and the measurement was performed with thermogravimetry (TG)-differential scanning calorimetry (DSC). TG-DSC was used to simultaneously measure a change in the weight of the internal lubricant and a change in the thermal energy of the internal lubricant. The test conditions were described below. FIG. 4 illustrates the results.

Stearamide: granular form

Test starting temperature: 50° C.

Increase in temperature to 450° C. at 20° C./min

Air atmosphere at 50 mL/min

The graph in FIG. 4 illustrates the measurement results of TG-DSC. The horizontal axis represents the atmospheric temperature (° C.). The right vertical axis represents the heat flow (mW/mg). The left vertical axis represents the percentage by mass of a sample (%). The dotted line in the figure represents a change in the weight of stearamide. The solid line represents the heat flow. Regarding the heat flow, portions represented by a 45° (positive slope) hatch pattern indicate endothermic reactions, and portions represented by a 135° (negative slope) hatch pattern indicate exothermic reactions.

In order of increasing temperature, the melting of stearamide occurs in the first endothermic reaction, and the oxidative decomposition of stearamide occurs in the subsequent exothermic reaction. With the oxidative decomposition of stearamide, the weight of stearamide is rapidly reduced.

In the second endothermic reaction, the thermal decomposition (carbonization) of stearamide occurs. With this, the weight of stearamide is further reduced. In the second exothermic reaction, the combustion of stearamide occurs. With regard to the exothermic reaction among these reactions, the starting temperature at which the oxidative decomposition occurred was about 171° C., the end temperature was about 265° C., and the peak temperature was about 234° C.

In order not to allow a residue to adhere to a surface of the dust core, it is important to heat-treat the compact in a decomposition temperature range where the oxidative decomposition of stearamide occurs (i.e., the temperature range of the first exothermic reaction). That is, the temperature of the low-temperature zone used for the first-stage heat treatment of the compact is 171° C. or higher and 265° C. or lower. Here, because the use of a higher temperature starts to cause stearamide to be partially carbonized, the actual heat-treatment temperature (temperature of the low-temperature zone) of the compact is preferably a temperature slightly lower than the peak temperature. For example, the heat-treatment temperature of the compact is the starting temperature of the exothermic reaction +0.3 to 0.6×[the temperature range of the exothermic reaction]. In the case of stearamide in this example, 171° C.+0.3×(265° C.−171° C.) or higher and 171° C.+0.6×(265° C.−171° C.) or lower, i.e., about 199° C. or higher and about 227° C. or lower may be used.

<<Test 2>>

Figure 5:
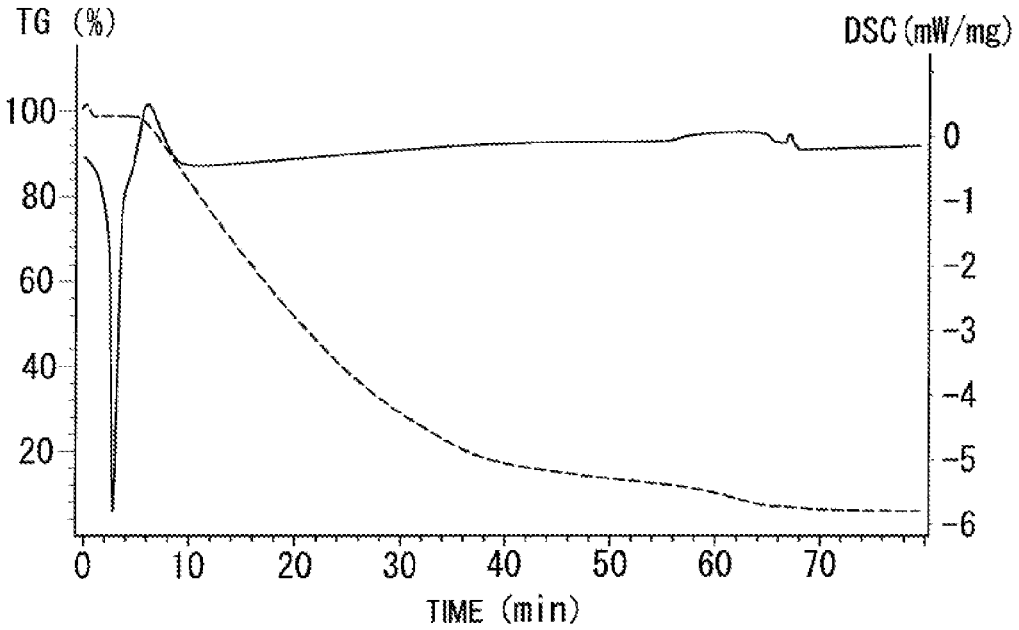
FIG. 5 is a graph depicting the results of thermogravimetry-differential scanning calorimetry of an internal lubricant described in test 2.

To determine an optimal time for which the compact is held in the decomposition temperature range, the percentage of a reduction in the weight of stearamide by heating was measured. The measurement was performed with TG-DSC. The test conditions were described below. FIG. 5 illustrates the results.

Stearamide: granular form

Test starting temperature: 50° C.

Increase in temperature to 240° C. at 40° C./min

Holding at 240° C. for 50 min

Increase in temperature to 340° C. at 14° C./min.

Holding at 360° C. for 15 min

In the graph of FIG. 5, the horizontal axis represents the time (min), the left vertical axis represents the percentage (%) of the reduction in the weight of stearamide, and the right vertical axis represents the heat flow (mW/mg). In FIG. 5, the dotted line represents the percentage of the reduction in weight, and the solid line represents a change in heat flow. As illustrated in FIG. 5, for about 5 minutes from the start of the test, the value of the heat flow is negative, which indicates that stearamide is melted by an endothermic reaction. Because the weight of stearamide remains unchanged during the endothermic reaction, stearamide seems to be just melted.

After a lapse of about 5 minutes from the start of the test, the value of the heat flow is positive, which indicates that stearamide is subjected to oxidative decomposition by an exothermic reaction and starts to evaporate. The weight of stearamide continued to reduce until about 55 minutes, at which point the temperature was maintained at 240° C., and was about 14% of the original weight. In particular, after about 30 minutes from the start of the reduction in the weight of stearamide (after about 35 minutes from the start of the test), the weight of stearamide was reduced to about 24% of the original weight. Although the weight of stearamide was further reduced during an increase in temperature from 240° C. to 340° C. (55 minutes to 65 minutes), the amount of reduction was just about 5.4% of the original weight. After 65 minutes, at which point the temperature was maintained at 340° C., the weight of stearamide remains almost unchanged.

The results described above indicated that in the case of stearamide, stearamide was mostly subjected to oxidative decomposition in 30 minutes after the temperature was maintained in the decomposition temperature range, and the amount oxidatively decomposed was saturated in 50 minutes. Accordingly, it was found that the time the compact is held in the decomposition temperature range is preferably 30 minutes or more and 50 minutes or less.

Test 3

From the results of tests 1 and 2, the oxidative decomposition temperature was determined to be 215° C.±10° C., the oxidative decomposition time was determined to be 30 minutes or more, the distortion removal temperature of the compact was determined to be 325° C.±25° C., and the distortion removal time was determined to be 20 minutes to 40 minutes. The compact was heat-treated with the carrier-type heat-treatment apparatus 1 illustrated in FIG. 1. The appearance of the dust core that has been heat-treated was visually checked for the presence of a residue on a surface of the dust core. In addition, the electrical resistance of the surface of the dust core was measured to evaluate the amount of residue.

[Compact to be Heat-Treated]

Figure 6:
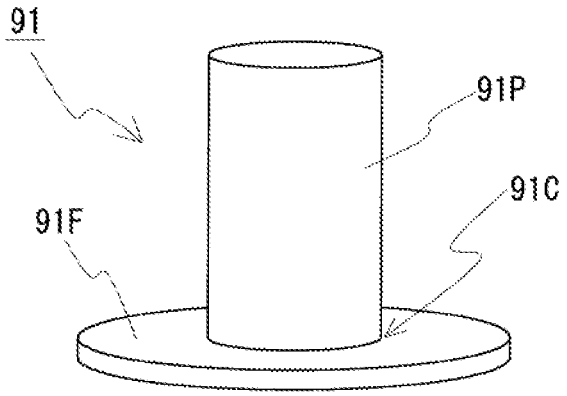
FIG. 6 is a schematic view of a compact having a flange portion and a compact having a rectangular frame-like shape.
Figure 6:
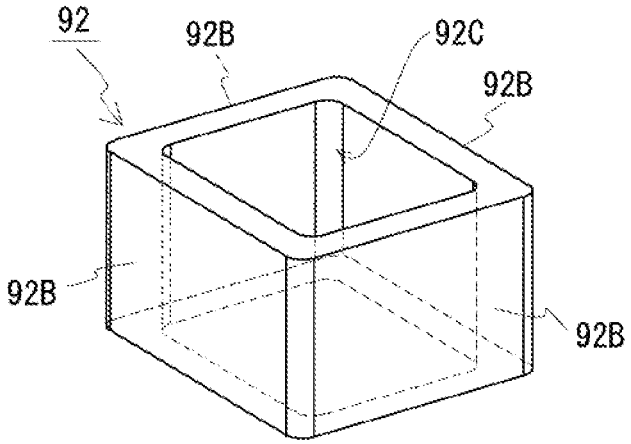

FIG. 6 illustrates compacts to be heat-treated. A compact 91 illustrated in the upper portion of FIG. 6 includes a columnar portion 91P and a flange portion 91F arranged on one end side of the columnar portion 91P. In the compact 91, a residue adheres easily to the boundary (edge portion 91C) between the columnar portion 91P and the flange portion 91F. A compact 92 illustrated in the lower portion of FIG. 6 is a compact that includes four plate-like portions 92B and that has a rectangular frame-like shape. In the compact 92, a residue adheres easily to the boundaries (edge portions 92C) between the plate-like portions 92B and 92B connected together.

[Arrangement of Compacts in Carrier-Type Heat-Treatment Apparatus]

Figure 7:
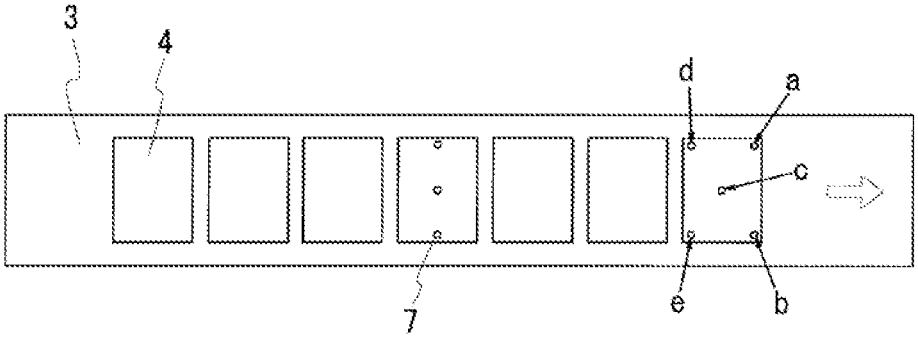
FIG. 7 is an explanatory drawing illustrating the arrangement state of compacts and sampling sites in test 3.

The arrangement of the compacts 91 and 92 are illustrated on the basis of FIG. 7 which is a top view of the mesh belt 3. In this test, as illustrated in FIG. 7, seven mesh stages 4 were aligned on the mesh belt 3, and the compacts 91 and 92 (see FIG. 6) were arranged on each of the mesh stages 4. Specifically, 195 compacts 91 having the columnar portion and the flange portion (see the upper portion of FIG. 6) were arranged with the flange portions facing down on the first, fourth, and seventh mesh stages 4 from the downstream end located on the right side of the paper in the transportation direction. Furthermore, 100 compacts having the rectangular frame-like shape (see the lower portion of FIG. 6) were arranged with the opening portions pointing to the transportation direction on the second, third, fifth, and sixth mesh stages 4 from the downstream end in the transportation direction. The total number of the compacts 91 and 92 arranged on the seven mesh stages 4 was about 1,000. Among the compacts arranged on the fourth mesh stage in the transportation direction, thermocouples 7 were attached to the compacts arranged on portions represented by circles in FIG. 7 to measure the temperature profile of heat treatment.

[Heat Treatment of Compact]

The temperature of each of the heaters 21 to 27, the amount of gas injected through the gas pipe 5, and the transportation speed (operating speed of the mesh belt) of the carrier-type heat-treatment apparatus 1 illustrated in FIG. 1 were set in such a manner that the compacts 91 and 92 transported by the mesh belt 3 were subjected to heat treatment at 215° C.±10° C. for 30 minutes or more and then heat treatment at 325° C.±25° C. for 20 minutes or more and 40 minutes or less.

The compacts 91 and 92 (see FIG. 6) were heat-treated with the carrier-type heat-treatment apparatus 1 (see FIG. 1) on which the setting were made as described above while the measurement results of the thermocouples 7 (see FIG. 7) attached to the compacts were monitored. Three thermocouples 7 indicated substantially the same measurement result. This demonstrated that the heat treatment was performed in the width direction of the mesh belt 3 without variations. From the monitoring results, the compacts were heated to about 215° C.±10° C. in the zone Z1 illustrated in FIG. 1 and maintained at 215° C.±10° C. in the zones Z2 to Z4. The compacts were heated to 325° C.±25° C. in the zone Z5 and maintained at 325° C.±25° C. in the zones Z6 and the almost end portion of the zone Z7. The passage time from the zone Z2 to the zone Z4 was about 30 minutes. In other words, the heat-treatment time of the compacts at 215° C. was about 30 minutes. The heat-treatment time of the compacts from the zone Z6 to the zone Z7 was about 30 minutes.

With regard to dust cores 101 and 102 (see FIG. 12) that had been heat-treated, all peripheral surfaces of the dust cores 101 and 102 were visually checked for the adhesion of a residue. In particular, edge portions 91C and 92C, to which a residue adheres easily, were checked for the adhesion of a residue. The residue has a clearly different color from the oxide coatings of the dust cores 101 and 102. If the residue adheres to a surface of each of the dust cores 101 and 102, the residue can be easily and visually identified. The results indicated that defective products (dust cores having the edge portions 101C and 102C to which the residues adhered) were found as follows: when viewed from the transportation direction, three defective products were found on the second mesh stage 4 (see FIG. 7), two defective products were found on the third mesh stage 4, one defective product was found on the fourth mesh stage 4, and one defective product was found on the seventh mesh stage 4. About 1,000 compacts 91 and 92 were heat-treated; thus, the incidence of the defective products due to this method for heat-treating the compacts 91 and 92 was only about 0.7%.

The dust cores 101 and 102 were sampled from each of the mesh stages 4. The electrical resistance (μΩ·m) and the amount of C (carbon) on the surface of each of the dust cores 101 and 102. As illustrated in FIG. 7, a total of five sampling sites were used: the front left end, which is represented by the lower-case alphabetic character "a", in the transportation direction; the front right end, which is represented by the lower-case alphabetic character "b", in the transportation direction; the center represented by "c"; the rear left end represented by "d" in the transportation direction; and the rear right end represented by "e" in the transportation direction. The electrical resistance was measured by a four-point probe method, and the amount of surface C was measured by EDX (acceleration voltage: 15 kV).

The electrical resistance is an index to confirm that the oxide coatings are uniformly arranged on the surfaces of the dust cores 101 and 102. In this test example, in the case of an electrical resistance of 100 μΩ·m or more, it is determined that the oxide coatings are uniformly arranged on the surfaces of the dust cores.

The amount of surface C is an index to confirm that no residue adheres to surfaces of the dust cores 101 and 102, and is the percentage of C in the total amount of atoms detected in the analysis of constituent elements on the surfaces. A residue formed by carbonization of stearamide is mainly composed of C (carbon). If the residue adheres to the surfaces of the dust cores 101 and 102, C is detected on the surfaces of the dust cores 101 and 102. In this test example, in the case where the amount of surface C of each dust core is 50 at % (atomic percent) or less, it is determined that no residue adheres to the surface of the dust core.

Figure 8:
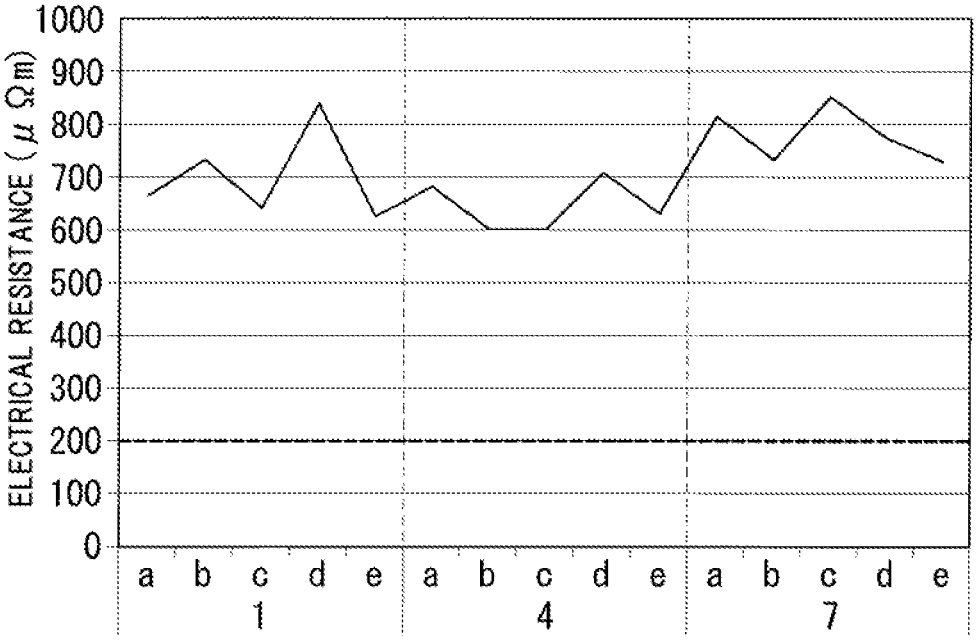
FIG. 8 is a graph depicting the electrical resistance of a dust core having a flange portion.
Figure 9:
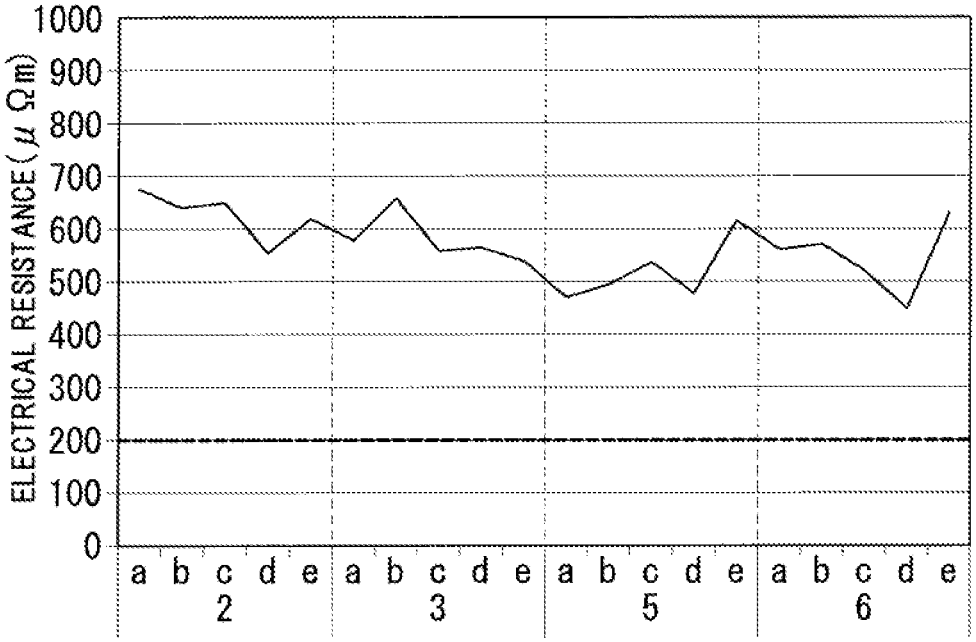
FIG. 9 is a graph depicting the electrical resistance of a dust core having a rectangular frame-like shape.
Figure 10:
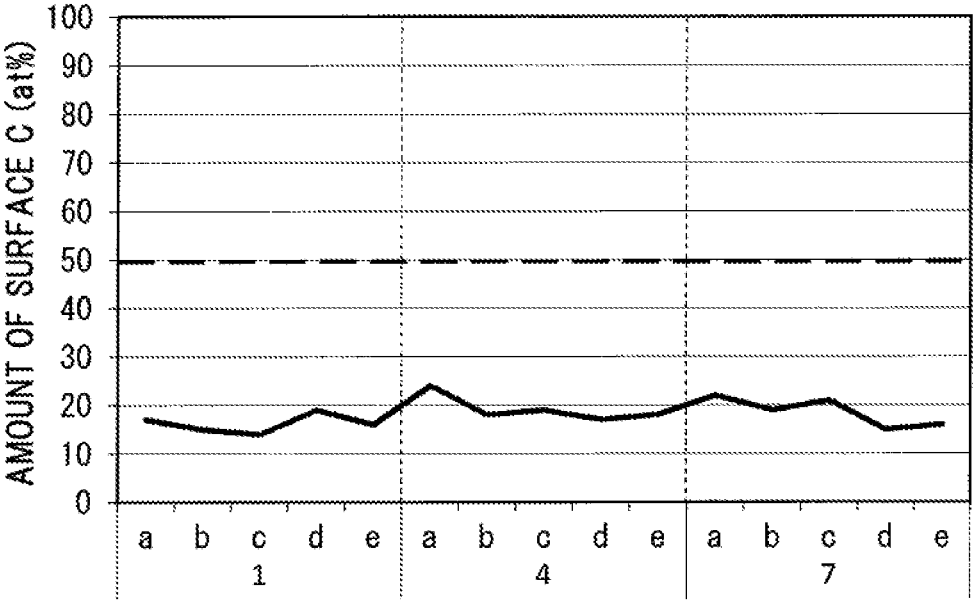
FIG. 10 is a graph depicting the amount of surface C of a dust core having a flange portion.
Figure 11:
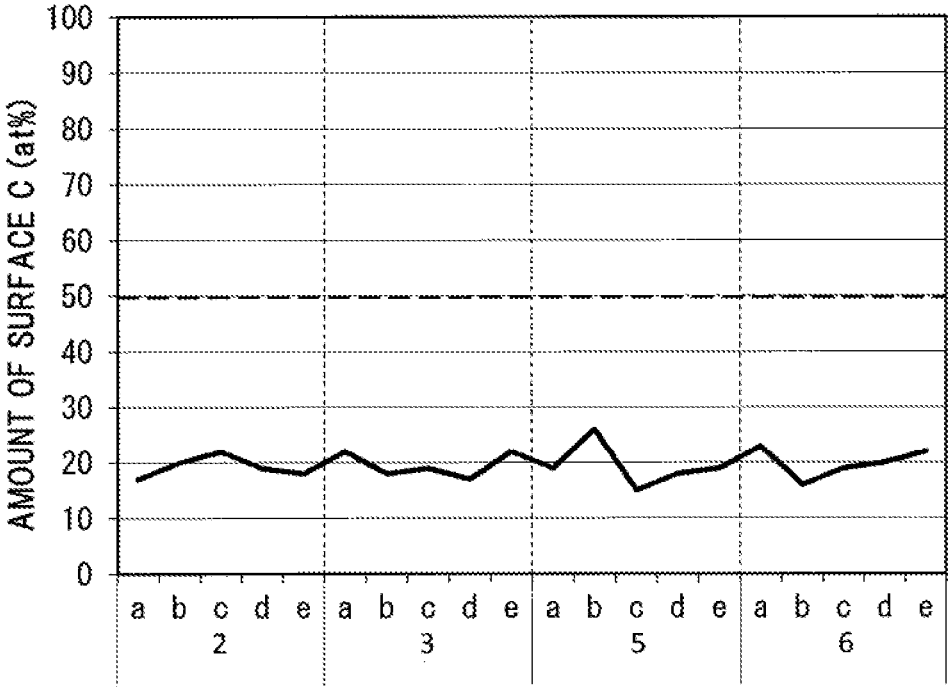
FIG. 11 is a graph depicting the amount of surface C of a dust core having a rectangular frame-like shape.
Figure 12:
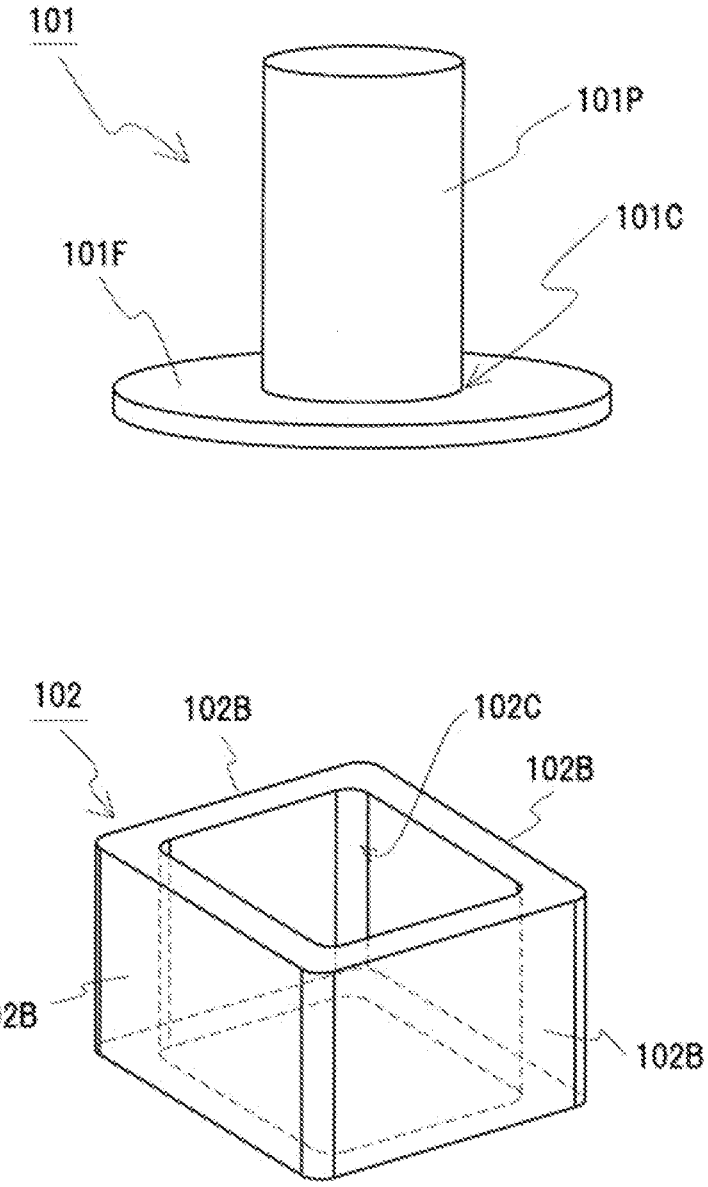
FIG. 12 is a schematic view illustrating a dust core having a flange portion and a dust core having a rectangular frame-like shape.

FIGS. 8 and 10 are graphs illustrating the sampling results of the dust cores 101 having the flange portion (see the upper portion of FIG. 12). FIGS. 9 and 11 are graphs illustrating the sampling results of the dust cores 102 having the rectangular frame-like shape (see the lower portion of FIG. 12). In each of FIGS. 8 and 9, the horizontal axis of the graph represents the sample number, and the vertical axis represents the electrical resistance of each sample. In each of FIGS. 10 and 11, the horizontal axis of the graph represents the sample number, and the vertical axis represents the amount of surface C of each sample. In these graphs, the numerals located in the lower portion of the sample number are numbers of the mesh stages 4 illustrated in FIG. 7 when viewed from the transportation direction, and the lower-case alphabetic characters located in the upper portion represent the sampling sites.

Each of the dust cores 101 having the flange portion illustrated in FIG. 8 had an electrical resistance of 600 μΩ·m or more. Each of the dust cores 102 having the rectangular frame-like shape illustrated in FIG. 9 had an electrical resistance of 250 μΩ·m or more. That is, the electrical resistance of each of the dust cores 101 and 102 sampled was 100 μΩ·m or more. This indicated that the oxide coatings were uniformly arranged on the surfaces of the dust cores 101 and 102.

The amount of surface C on the edge portion 101C, at which a residue was easily formed, of each of the dust cores 101 having the flange portion illustrated in FIG. 10 was 30 at % or less. The amount of surface C on each of the edge portions 102C, at which a residue was easily formed, of the dust cores 102 having the rectangular frame-like shape illustrated in FIG. 11 was 30 at % or less. That is, the amount of surface C of each of the dust cores 101 and 102 sampled was 50 at % or less. This indicated that no residue adhered to the surface of the dust core 101 or 102.

<<Summary of Tests 1 to 3>>

Tests 1 to 3 revealed that the carrier-type heat-treatment apparatus 1 according to the embodiment is suitable for the production of the dust core having no residue left on its surface.

<<Test 4>>

In test 4, sample I subjected to the two-stage heat treatment with the carrier-type heat-treatment apparatus 1 illustrated in FIG. 1 and sample II subjected to a single-stage heat treatment with a conventional carrier-type heat-treatment apparatus were produced. The DC magnetization characteristics (maximum relative magnetic permeability $\mu_m$) and the transverse rupture strength (MPa) of each of samples I and II were measured.

The first-stage heat treatment for sample I was performed at 215° C.±10° C. for 1.5 hours, and the second-stage heat treatment was performed 525° C.±25° C. for 15 minutes. The heat treatment for sample II was performed at 525° C.±25° C. for 15 minutes. For both samples I and II, the rate of temperature increase was 5° C./min, and the heat-treatment atmosphere was air.

Samples I and II were subjected to an evaluation test of the DC magnetization characteristics according to JIS C 2560-2. The DC magnetization characteristics were evaluated with measurement components in which test pieces having a ring-like shape with an outside diameter of 34 mm, an inside diameter of 20 mm, and a thickness of 5 mm each had 300 turns of the primary winding and 20 turns of the secondary winding.

The results of the evaluation test indicated that sample I had a maximum relative magnetic permeability $\mu_m$ of 605 and sample II had a maximum relative magnetic permeability $\mu_m$ of 543. That is, the maximum relative magnetic permeability $\mu_m$ of sample I subjected to the two-stage heat treatment was about 1.1 times that of sample II subjected to the single-stage heat treatment.

Samples I and II were subjected to an evaluation test of transverse rupture strength (three-point flexural test) according to JIS Z 2511. Rectangular plate-shaped test pieces measuring 55 mm×10 mm×10 mm were used for the evaluation of the transverse rupture strength. The results of the flexural test indicated that sample I had a transverse rupture strength of 74.1 MPa and sample II had a transverse rupture strength of 41.1 MPa. That is, the transverse rupture strength of sample I subjected to the two-stage heat treatment was about 1.8 times that of sample II subjected to the single-stage heat treatment.

The difference between the methods for producing samples I and II is only whether the two-stage heat treatment is performed or not. The reason sample I had better characteristics than sample II is presumably that almost all the compacting assistant was removed from the inside of the compact through the first-stage heat treatment.

INDUSTRIAL APPLICABILITY

The carrier-type heat-treatment apparatus according to the present invention is suitably used to heat-treat compacts that can be used as magnetic cores of various coil components (for example, reactors, transformers, motors, choke coils, antennas, fuel injectors, and ignition coils (sparking coils)) and materials thereof.

REFERENCE SIGNS LIST

1 carrier-type heat-treatment apparatus
2 furnace main body 21 to 27 heater 2E exterior 2M muffle
3 mesh belt
4 mesh stage
5 gas pipe
6 heat insulator
7 thermocouple
Z1 to Z7 zone
9 object to be heat-treated
91, 92 compact (object to be heat-treated)
91P columnar portion 91F flange portion 91C edge portion
92B plate-like portion 92C edge portion
101, 102 dust core (product after heat treatment)
101P columnar portion 101F flange portion 101C edge portion
102B plate-like portion 102C edge portion

The invention claimed is:

1. A carrier heat-treatment apparatus including a furnace main body that includes heaters and a mesh belt that transports an object to be heat-treated into the furnace main body, comprising:

a gas pipe arranged inside the furnace main body, the gas pipe being configured to inject a gas into the furnace main body, wherein a low-temperature zone and a high-temperature zone are provided inside the furnace main body with the gas, the low-temperature zone being provided on an entrance side of the furnace main body, the high-temperature zone being provided on an exit side of the furnace main body and having a temperature higher than the low-temperature zone, wherein the heaters are aligned in a transportation direction of the object to be heat-treated, wherein a heat insulator is arranged in a gap that is selected from gaps between the heaters aligned in the transportation direction and that is located in the vicinity of the gas pipe, and wherein the gas from the gas pipe does not provide heat insulation within any of the gaps between the heaters aligned in the transportation direction.

2. The carrier heat-treatment apparatus according to claim 1, wherein the gas pipe is arranged above the mesh belt and in a direction, intersecting a direction of motion of the mesh belt, and the gas pipe includes a nozzle arranged on a peripheral wall thereof, the nozzle being configured to inject the gas.

3. The carrier heat-treatment apparatus according to claim 1, wherein an injection direction of the gas is a direction toward an upper portion of the low-temperature zone rather than a vertically downward direction.

4. The carrier heat-treatment apparatus according to claim 1, further comprising a temperature sensor in the furnace main body, wherein the gas is maintained at a temperature equal to car lower than a set temperature of the low-temperature zone based on detection results of the temperature sensor.

5. The carrier heat-treatment apparatus according to claim 1, further comprising an inert gas storage facility coupled to the gas pipe, wherein the gas is an inert gas supplied from the inert gas storage facility.

6. The carrier heat-treatment apparatus according to claim 1, farther comprising a flow gas introduction mechanism configured to introduce a flow gas from the exit side toward the entrance side of the furnace main body, wherein the flow as is air.

* * * * *